US009905150B2

(12) United States Patent
Sasaki

(10) Patent No.: US 9,905,150 B2
(45) Date of Patent: Feb. 27, 2018

(54) DISPLAY APPARATUS AND CONTROL METHOD OF DISPLAY APPARATUS

(71) Applicant: Sakai Display Products Corporation, Sakai-shi, Osaka (JP)

(72) Inventor: Takashi Sasaki, Sakai (JP)

(73) Assignee: SAKAI DISPLAY PRODUCTS CORPORATION, Osaka (JP)

( * ) Notice: Subject to any disclaimer, the term of this patent is extended or adjusted under 35 U.S.C. 154(b) by 61 days.

(21) Appl. No.: 14/392,327

(22) PCT Filed: Jun. 16, 2014

(86) PCT No.: PCT/JP2014/065897
§ 371 (c)(1),
(2) Date: Dec. 23, 2015

(87) PCT Pub. No.: WO2014/208383
PCT Pub. Date: Dec. 31, 2014

(65) Prior Publication Data

US 2016/0180761 A1 Jun. 23, 2016

(30) Foreign Application Priority Data

Jun. 28, 2013 (JP) ..... 2013-136887

(51) Int. Cl.
*G09G 3/20* (2006.01)
*G09G 3/36* (2006.01)

(52) U.S. Cl.
CPC ..... *G09G 3/2018* (2013.01); *G09G 3/36* (2013.01); *G09G 2310/0248* (2013.01); (Continued)

(58) Field of Classification Search
CPC ..... G09G 2320/0252; G09G 2360/16; G09G 2340/16; G09G 2320/0285; G09G 2310/06; G09G 2320/0233; G09G 3/3696
See application file for complete search history.

(56) References Cited

U.S. PATENT DOCUMENTS

2004/0155893 A1 8/2004 Furukawa et al.
2006/0033727 A1* 2/2006 Hsu ..... G09G 3/3648 345/204

(Continued)

FOREIGN PATENT DOCUMENTS

JP 2006-106663 4/2006
JP 4425643 B2 3/2010

*Primary Examiner* — Sanjiv D Patel
(74) *Attorney, Agent, or Firm* — Rudy J. Ng; Bret E. Field; Bozicevic, Field & Francis LLP

(57) ABSTRACT

During displaying a moving image on a liquid crystal panel, when the brightness of the pixel in an image to be displayed is a prescribed setting value or more, the display apparatus performs the overdrive control for changing the brightness of the pixel from the brightness in one previous image to a middle value between the brightness in the one previous image and the brightness to be displayed, and then changing to the brightness to be displayed. The setting value is, for example, a maximum value of a displayable brightness or a value near the maximum value. If the brightness of the pixel in the one previous image is a first threshold value or less, the display apparatus performs the same overdrive control. Even when the brightness of the pixel in the one previous image is misidentified as other values of the first threshold value or less with a minimum displayable value, the same overdrive control as the case in which the brightness of the one previous image is the minimum value is performed.

8 Claims, 6 Drawing Sheets

| | | CURRENT FRAME | | | | | | |
|---|---|---|---|---|---|---|---|---|
| | | 0 | 16 | 32 | · | 224 | 240 | 255 |
| PREVIOUS FRAME | 0 | 0 | 26 | 63 | · | 221 | 236 | 244 |
| | 16 | 0 | 16 | 49 | · | 223 | 239 | 244 |
| | 32 | 0 | 6 | 32 | · | 225 | 242 | 244 |
| | 48 | 0 | 6 | 23 | · | 229 | 247 | 244 |
| | 64 | 0 | 6 | 21 | · | 229 | 247 | 244 |
| | 80 | 0 | 5 | 20 | · | 229 | 247 | 244 |
| | 96 | 0 | 4 | 17 | · | 229 | 247 | 244 |
| | 112 | 0 | 4 | 15 | · | 229 | 247 | 244 |
| | 128 | 0 | 4 | 14 | · | 229 | 247 | 244 |
| | 144 | 0 | 4 | 12 | · | 229 | 247 | 247 |
| | · | · | · | · | · | · | · | · |
| | 240 | 0 | 4 | 7 | · | 220 | 240 | 252 |
| | 255 | 0 | 4 | 7 | · | 213 | 231 | 255 |

(52) U.S. Cl.
CPC ..... *G09G 2320/0252* (2013.01); *G09G 2320/0271* (2013.01); *G09G 2320/0285* (2013.01); *G09G 2320/064* (2013.01); *G09G 2340/16* (2013.01)

(56) References Cited

U.S. PATENT DOCUMENTS

| | | | | |
|---|---|---|---|---|
| 2006/0071927 | A1* | 4/2006 | Chang | G02F 1/133707 345/211 |
| 2006/0164365 | A1* | 7/2006 | Huang | G09G 3/36 345/98 |
| 2009/0021499 | A1* | 1/2009 | Chen | G09G 3/2007 345/204 |
| 2012/0154345 | A1* | 6/2012 | Kim | G09G 3/3648 345/204 |

* cited by examiner

FIG. 3

| | | CURRENT FRAME | | | | | | |
|---|---|---|---|---|---|---|---|---|
| | | 0 | 16 | 32 | ▪ | 224 | 240 | 255 |
| PREVIOUS FRAME | 0 | 0 | 26 | 63 | ▪ | 221 | 236 | 244 |
| | 16 | 0 | 16 | 49 | ▪ | 223 | 239 | 244 |
| | 32 | 0 | 6 | 32 | ▪ | 225 | 242 | 244 |
| | 48 | 0 | 6 | 23 | ▪ | 229 | 247 | 244 |
| | 64 | 0 | 6 | 21 | ▪ | 229 | 247 | 244 |
| | 80 | 0 | 5 | 20 | ▪ | 229 | 247 | 244 |
| | 96 | 0 | 4 | 17 | ▪ | 229 | 247 | 244 |
| | 112 | 0 | 4 | 15 | ▪ | 229 | 247 | 244 |
| | 128 | 0 | 4 | 14 | ▪ | 229 | 247 | 244 |
| | 144 | 0 | 4 | 12 | ▪ | 229 | 247 | 255 |
| | ▪ | ▪ | ▪ | ▪ | ▪ | ▪ | ▪ | ▪ |
| | 240 | 0 | 4 | 7 | ▪ | 220 | 240 | 255 |
| | 255 | 0 | 4 | 7 | ▪ | 213 | 231 | 255 |

FIG. 5

| | | CURRENT FRAME | | | | | | |
|---|---|---|---|---|---|---|---|---|
| | | 0 | 16 | 32 | ・ | 224 | 240 | 255 |
| PREVIOUS FRAME | 0 | 0 | 26 | 63 | ・ | 221 | 236 | 244 |
| | 16 | 0 | 16 | 49 | ・ | 223 | 239 | 244 |
| | 32 | 0 | 6 | 32 | ・ | 225 | 242 | 244 |
| | 48 | 0 | 6 | 23 | ・ | 229 | 247 | 244 |
| | 64 | 0 | 6 | 21 | ・ | 229 | 247 | 244 |
| | 80 | 0 | 5 | 20 | ・ | 229 | 247 | 244 |
| | 96 | 0 | 4 | 17 | ・ | 229 | 247 | 244 |
| | 112 | 0 | 4 | 15 | ・ | 229 | 247 | 244 |
| | 128 | 0 | 4 | 14 | ・ | 229 | 247 | 244 |
| | 144 | 0 | 4 | 12 | ・ | 229 | 247 | 247 |
| | ・ | ・ | ・ | ・ | ・ | ・ | ・ | ・ |
| | 240 | 0 | 4 | 7 | ・ | 220 | 240 | 252 |
| | 255 | 0 | 4 | 7 | ・ | 213 | 231 | 255 |

FIG. 6

| | | CURRENT FRAME | | | | | | |
|---|---|---|---|---|---|---|---|---|
| | | 0 | 16 | 32 | · | 224 | 240 | 255 |
| PREVIOUS FRAME | 0 | 0 | 26 | 63 | · | 221 | 236 | 244 |
| | 16 | 0 | 16 | 49 | · | 223 | 239 | 244 |
| | 32 | 0 | 6 | 32 | · | 225 | 242 | 244 |
| | 48 | 0 | 6 | 23 | · | 229 | 247 | 244 |
| | 64 | 0 | 6 | 21 | · | 229 | 247 | 244 |
| | 80 | 0 | 5 | 20 | · | 229 | 247 | 244 |
| | 96 | 0 | 4 | 17 | · | 229 | 247 | 247 |
| | 112 | 0 | 4 | 15 | · | 229 | 247 | 250 |
| | 128 | 0 | 4 | 14 | · | 229 | 247 | 252 |
| | 144 | 0 | 4 | 12 | · | 229 | 247 | 253 |
| | · | · | · | · | · | · | · | · |
| | 240 | 0 | 4 | 7 | · | 220 | 240 | 254 |
| | 255 | 0 | 4 | 7 | · | 213 | 231 | 255 |

DISPLAY APPARATUS AND CONTROL METHOD OF DISPLAY APPARATUS

This application is the national phase under 35 U.S.C. §371 of PCT International Application No. PCT/JP2014/065897 which has an International filing date of Jun. 16, 2014 and designated the United States of America.

BACKGROUND

1. Technical Field

The present invention relates to a display apparatus for displaying an image using a liquid crystal panel, and a control method of the display apparatus.

2. Description of Related Art

In a display apparatus for displaying an image using a liquid crystal panel, a response of a change in brightness may be delayed, and an image quality of a moving image may be deteriorated, according to an amount of change in the brightness of a pixel. For example, a so-called tailing in which a moving object in the moving image is displayed while having a tail occurs. Therefore, in the display apparatus, an overdrive control is performed which controls the liquid crystal panel so as to change the brightness of the pixel by an amount of change so that the response of the change in the brightness becomes faster, and then changing to an intended brightness, and thereby improving the response of the brightness. Japanese Patent Publication No. 4425643 discloses a technique that appropriately determines parameters for the overdrive control.

Conventionally, a vertical alignment (VA) type liquid crystal panel, in which a non-transmission state of light is represented by vertically aligning a liquid crystal with respect to a display surface, and a transmission state of light is represented using a refractive index which is changed by applying a voltage to the liquid crystal to bring down the liquid crystal, is used. In the display apparatus including the VA type liquid crystal panel, there is a problem that the response is delayed when the brightness of the pixel is greatly changed. Therefore, in the display apparatus including the VA type liquid crystal panel, when changing the brightness of the pixel from a minimum value of a displayable brightness to a maximum value thereof or a value near the maximum value, the overdrive control is performed which controls the liquid crystal panel so as to change the brightness of the pixel to a brightness between the minimum value and the brightness to be displayed, and then change to the maximum value or the value near the maximum value. For example, when controlling the brightness by 256 gradations, the liquid crystal panel is controlled so as to change a gradation value representing the brightness of the pixel from a gradation value 0 to a gradation value 244, and then to a gradation value 255.

SUMMARY OF THE INVENTION

In the display apparatus, the overdrive control according to a difference in the brightness is performed by storing image data for each frame, and comparing the brightness of each pixel in a frame to be displayed and one previous frame thereof. However, when compressing and storing the image data and decompressing and reading the same, the brightness of the pixel may be misidentified due to an error in the compression and decompression. For example, the brightness of the minimum value may be misidentified as a greater brightness. If the brightness of the pixel is misidentified, it is not possible to appropriately perform the overdrive control. For example, if it is misidentified as a greater brightness even though the brightness of the pixel in the one previous frame is the minimum value, when the brightness of the pixel in the frame to be displayed is the maximum value or the value near the maximum value, the overdrive control is not appropriately performed.

Due to the overdrive control being not appropriately performed, the response of the change in the brightness of the pixel is delayed, and thereby the image quality of the moving image is deteriorated. For example, in the moving image in which an extreme change in the brightness occurs such as a moving image in which a square graphic of a mixed color moves in a horizontal direction on a white background, the tailing occurs, and the image quality is deteriorated. This problem is a problem that often occurs in the VA type liquid crystal panel.

In consideration of the above-described circumstances, it is an object of the present invention to provide a display apparatus capable of preventing image quality of a moving image from being deteriorated by reliably performing an overdrive control even when a brightness of a pixel is misidentified, and a control method of a display apparatus.

A display apparatus according to the present invention comprises: a liquid crystal panel configured to sequentially display a plurality of images respectively including a plurality of pixels; a storage section configured to sequentially store image data representing each of the images, and read the image data representing one previous image of an image to be displayed; and a control means configured to control a brightness of the pixel included in the image displayed by the liquid crystal panel, so as to, for each of the pixels included in the image, when the brightness of the pixel in the image representing the image data read by the storage section is a value included in a prescribed range, and the brightness of the pixel in the image to be displayed is a prescribed setting value or more, change the brightness of the pixel from the brightness in the one previous image to a middle value between a value of the brightness in the image represented by the image data and a value of the brightness in the image to be displayed, and then change to a value of the brightness in the image to be displayed. The display apparatus is characterized in that the control section comprises a means configured to, when the brightness of the pixel included in the image represented by the image data read by the storage section is a first prescribed threshold value or less which is less than the setting value but exceeds a minimum value of a displayable brightness, determine the middle value to be a prescribed constant value exceeding the first threshold value.

The display apparatus according to the present invention is characterized in that the setting value is a maximum value of the displayable brightness.

The display apparatus according to the present invention is characterized in that the control means comprises a means configured to, when the brightness of the pixel included in the image represented by the image data read by the storage section exceeds the first threshold value and is a second prescribed threshold value or less which is less than the setting value but exceeds the first prescribed threshold value, determine the middle value to be a large value as a value of the brightness of the pixel increases exceeding the constant value.

The display apparatus according to the present invention is characterized in that the storage section includes: a means configured to compress and store image data; and a means configured to read and decompress the image data. The first threshold value is an upper limit value of a value for which the brightness of the pixel, included in the image represented by the image data read by the storage section, may be misidentified with the minimum value due to an error of compression and decompression algorithms.

The display apparatus according to the present invention is characterized in that the storage section includes: a means configured to compress and store image data; and a means configured to read and decompress the image data. The first threshold value is less than the upper limit value of a value for which the brightness of the pixel, included in the image represented by the image data read by the storage section, may be misidentified with the minimum value due to an error of the compression and decompression algorithms, and the second threshold value is the upper limit value or more.

The display apparatus according to the present invention is characterized in that the control means stores a corresponding table in which the middle value is associated with the value of the brightness of the pixel, and the control means is configured so as to determine the middle value according to the brightness of the pixel included in the image represented by the image data read by the storage section, based on the corresponding table.

A control method according to the present invention controls a display apparatus which comprises a liquid crystal panel configured to sequentially display a plurality of images respectively including a plurality of pixels, and a storage section configured to sequentially store image data representing each of the images, and read the image data representing one previous image of an image to be displayed. The display apparatus is configured to control a brightness of the pixel included in the image displayed by the liquid crystal panel, so as to, for each of the pixels included in the image, when the brightness of the pixel in the image representing the image data read by the storage section is a value included in a prescribed range, and the brightness of the pixel in the image to be displayed is a prescribed setting value or more, change the brightness of the pixel from the brightness in the one previous image to a middle value between a value of the brightness in the image represented by the image data and a value of the brightness in the image to be displayed, and then change to a value of the brightness in the image to be displayed. The control method is characterized by comprising, when the brightness of the pixel included in the image represented by the image data read by the storage section is a first prescribed threshold value or less which is less than the setting value but exceeds a minimum value of a displayable brightness, determining the middle value to be a prescribed constant value exceeding the first threshold value.

In the present invention, the display apparatus sequentially displays the image on the liquid crystal panel, sequentially stores the image data representing the image in the storage section, and reads the image data representing the one previous image of the image to be displayed. When the brightness of the pixel in the image to be displayed is the prescribed setting value or more, the display apparatus controls the brightness of the pixel so as to once change it from the brightness in the one previous image to a middle value between the brightness of the pixel in the one previous image obtained by the read image data and the brightness of the pixel to be displayed, and then change to the brightness to be displayed. The setting value is, for example, the maximum value of the displayable brightness or a value near the maximum value. If the brightness of the pixel in the one previous image is the first threshold value or less, the display apparatus performs the control using the middle value as the constant value. Even when the brightness of the pixel in the one previous image exceeds the minimum value of the displayable brightness, if the brightness of the pixel in the one previous image is the first threshold value or less, the display apparatus performs the same control as the case in which the brightness of the pixel in the one previous image is the minimum value.

In addition, in the present invention, the setting value is the maximum value of the displayable brightness. Therefore, when the brightness of the pixel in the image to be displayed is the maximum value, the display apparatus controls the brightness of the pixel, so as to once change the brightness of the pixel from the brightness in the one previous image to the middle value, and then change to the maximum value.

Further, in the present invention, even when the brightness of the pixel exceeds the first threshold value but is the second threshold value or less in the one previous image, and is the setting value or more in the image to be displayed, the display apparatus changes the brightness of the pixel from the brightness in the one previous image to the middle value, and then changes to the brightness of the setting value or more. The middle value uses a value which is larger than a middle value in the case that the brightness of the pixel in the one previous image is the first threshold value or less, and is increased as the brightness of the one previous image increases.

Further, in the present invention, the first threshold value is an upper limit value of a value for which the brightness of the pixel in the one previous image may be misidentified from the minimum value due to an error of the compression and decompression of the image in the storage section. Even when the brightness of the pixel in the one previous image that should be the minimum value is misidentified, the same control as the case in which the brightness of the one previous image is the minimum value is reliably performed.

Furthermore, in the present invention, the first threshold value is less than the upper limit value of a value for which the brightness of the pixel in the one previous image may be misidentified from the minimum value due to an error of the compression and decompression of the image in the storage section. The middle value of, when the brightness of the pixel in the one previous image exceeds the first threshold value, exceeds the middle value when the brightness of the pixel in the one previous image is the first threshold value or less.

Furthermore, in the present invention, the display apparatus stores the corresponding table in which the middle value is associated with the value of the brightness of the pixel, and determines the middle value according to the corresponding table.

According to the present invention, when the brightness of the pixel in the one previous frame is misidentified as other values from the minimum value, the display apparatus performs the same overdrive control as the case of changing the brightness of the pixel from the minimum value. Therefore, the present invention exhibits excellent effects, for example, the display apparatus reliably performs the overdrive control even when the brightness of the pixel is misidentified, such that it is possible to prevent a deterioration in the image quality of the moving image and the like.

The above and further objects and features of the invention will more fully be apparent from the following detailed description with accompanying drawings.

BRIEF DESCRIPTION OF THE SEVERAL VIEWS OF THE DRAWINGS

FIG. 3 is a view conceptually illustrating an example of contents of a lookup table according to Embodiment 1;

FIG. 5 is a view conceptually illustrating an example of contents of a lookup table according to Embodiment 2; and FIG. 6 is a view conceptually illustrating an example of contents of a lookup table according to Embodiment 3.

DETAILED DESCRIPTION

Hereinafter, the present invention will be described in detail with reference to the accompanying drawings illustrating the embodiments thereof.

Embodiment 1

Figure 1:
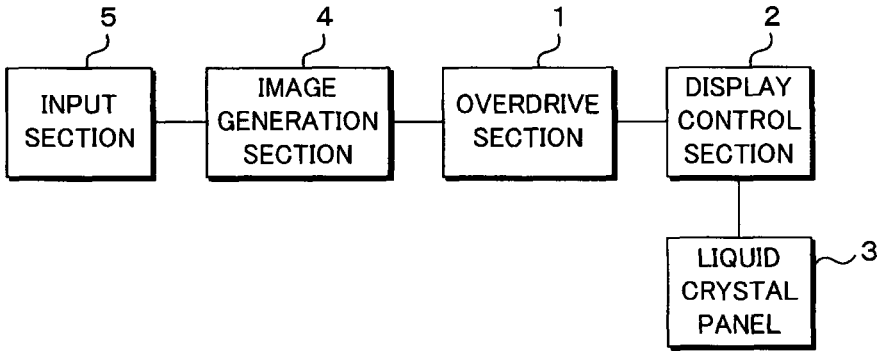
FIG. 1 is a block diagram illustrating a functional configuration of an inside of a display apparatus.

FIG. 1 is a block diagram illustrating a functional configuration of an inside of a display apparatus. The display apparatus includes a liquid crystal panel 3, and displays an image including a plurality of pixels by using the liquid crystal panel 3. For example, the display apparatus is a television receiver or a monitor apparatus. The display apparatus includes an input section 5 to which data is input from an outside. The input section 5 is an interface section for inputting the data or a tuner to which broadcast data is input. The input section 5 is connected with an image generation section 4. The image generation section 4 generates image data representing an image for displaying using the liquid crystal panel 3, based on the data input to the input section 5. When displaying a moving image, the image generation section 4 sequentially generates a plurality of image data representing a plurality of images forming the moving image. The image generation section 4 is connected with an overdrive section 1. The image generation section 4 sequentially inputs the plurality of image data to the overdrive section 1. The overdrive section 1 sequentially generates an image signal for displaying an image on the liquid crystal panel 3 while performing an overdrive control. The overdrive section 1 and the liquid crystal panel 3 are connected with a display control section 2. The display control section 2 performs a process for sequentially displaying the image on the liquid crystal panel 3, according to the image signal sequentially generated by the overdrive section 1. Each of the images corresponds to each of frames of the moving image. By sequentially displaying the plurality of images, the liquid crystal panel 3 displays the moving image.

Figure 2:
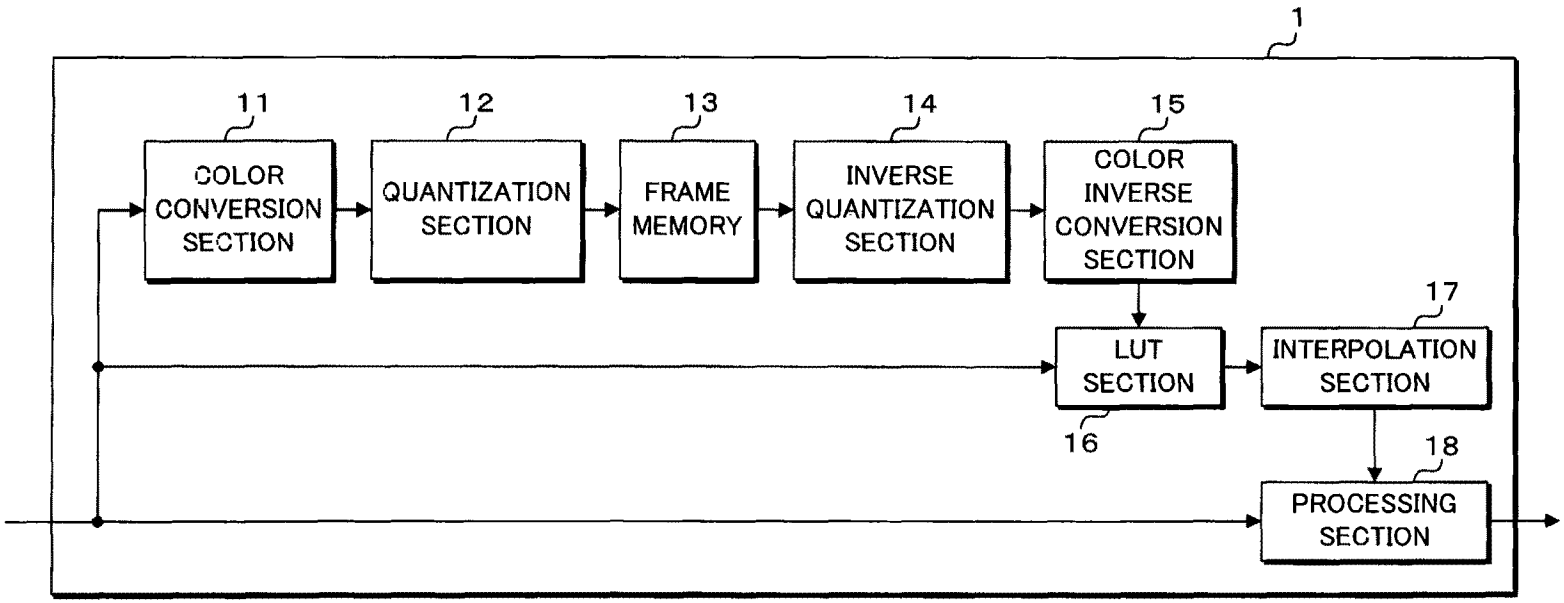
FIG. 2 is a block diagram illustrating an internal configuration of an overdrive section.

FIG. 2 is a block diagram illustrating an internal configuration of the overdrive section 1. The overdrive section 1 includes a color conversion section 11, a quantization section 12, a frame memory 13, an inverse quantization section 14, and a color inverse conversion section 15. The frame memory 13 includes a random access memory (RAM). The image data for one frame generated by the image generation section 4 is input to the color conversion section 11, and the color conversion section 11 performs a color conversion for compressing the image data. The quantization section 12 quantizes the image data after the color conversion, thus to compress the image data. The frame memory 13 stores the compressed image data representing one frame. The inverse quantization section 14 reads the image data from the frame memory 13, and performs inverse quantization of the read image data. The color inverse conversion section 15 performs a color inverse conversion on the inversely quantized image data, thus to decompress the image data stored in the frame memory 13. The color conversion section 11, the quantization section 12, the frame memory 13, the inverse quantization section 14 and the color inverse conversion section 15 correspond to a storage section in the present invention. The image data sequentially generated by the image generation section 4 is sequentially stored and read.

In addition, the overdrive section 1 includes a lookup table (LUT) section 16. The LUT section 16 previously stores a lookup table recorded with a target value of the brightness to try to once change the brightness of the pixel by the overdrive control from the brightness in one previous frame of a frame to be displayed by associating with a combination of the values of the brightness of the pixels in two frames. The lookup table corresponds to a corresponding table in the present invention.

FIG. 3 is a view conceptually illustrating an example of contents of the lookup table according to Embodiment 1. The brightness of the pixel is represented by any one of gradation values of 0 to 255. The gradation value 0 is a minimum value of the displayable brightness, and the gradation value 255 is a maximum value of the displayable brightness. In the lookup table, the gradation value representing the target value of the brightness is recorded by associating with a combination of the gradation value representing the brightness in one previous image (previous frame) of an image to be displayed and the gradation value representing the brightness in the image (current frame) to be displayed. For example, by associating the gradation value 0 in the previous frame and the gradation value 255 in the current frame, a gradation value 244 is recorded therein. The target value of less than the gradation value 255 associated with the gradation value 255 in the current frame corresponds to a middle value in the present invention. The value recorded in the lookup table is previously determined.

The LUT section 16 determines the target value in the overdrive control according to the recorded lookup table. The LUT section 16 is connected with the color inverse conversion section 15 and an interpolation section 17. The interpolation section 17 calculates the target value of the brightness of the pixel by interpolation according to a combination which is not recorded in the lookup table, among the combinations of the values of the brightness of pixels in two frames. By the calculation in the interpolation section 17, the target value of the brightness for which the brightness of each pixel included in the image is to once change from the brightness in the previous frame, is determined. The interpolation section 17 is connected with a processing section 18. The processing section 18 generates an image signal for once changing the brightness of the pixel to the target value determined for each pixel based on the brightness in the previous frame, and then changing to the brightness in the current frame which is the image to be displayed. The LUT section 16, the interpolation section 17, the processing section 18 and the display control section 2 correspond to a control means in the present invention.

As illustrated in FIG. 2, the image data sequentially input from the image generation section 4 to the overdrive section 1 is input in parallel to the color conversion section 11, the LUT section 16 and the processing section 18. The image data is compressed by the color conversion section 11 and the quantization section 12 and is stored in the frame memory 13. The image data representing the previous frame stored in the frame memory 13 is read from the frame memory 13, is decompressed in the inverse quantization section 14 and the color inverse conversion section 15, and is input to the LUT section 16. The LUT section 16 specifies the value of the brightness of each pixel in two frames, based on the image data representing the current frame and the image data representing the previous frame. The LUT section 16 then specifies the target value of the brightness associated with the combination of the specified value of the brightness of each pixel, by referring to the stored lookup table. The interpolation section 17 calculates, by the interpolation, the target value of the brightness according to the combination of the brightness of the pixel which is not recorded in the lookup table, and determines the target value of the brightness of each pixel. The interpolation section 17 inputs the determined target value of the brightness of each pixel to the processing section 18. The processing section 18 generates an image signal for once changing the brightness of each pixel from the brightness in the previous frame to the target value, and then changing to the brightness in the current frame, based on the input image data representing the current frame and the target value of the brightness of each pixel, and inputs the generated image data to the display control section 2.

The overdrive section 1 generates an image signal by the processing section 18, each time when the image data is sequentially input from the image generation section 4, and inputs the generated image signal to the display control section 2. The display control section 2 displays the image on the liquid crystal panel 3 based on the input image signal. In this case, the display control section 2 controls the brightness of the pixel included in the image, based on the image signal generated by the overdrive section 1. Accordingly, the image on which the overdrive control is performed is displayed.

Figure 4:
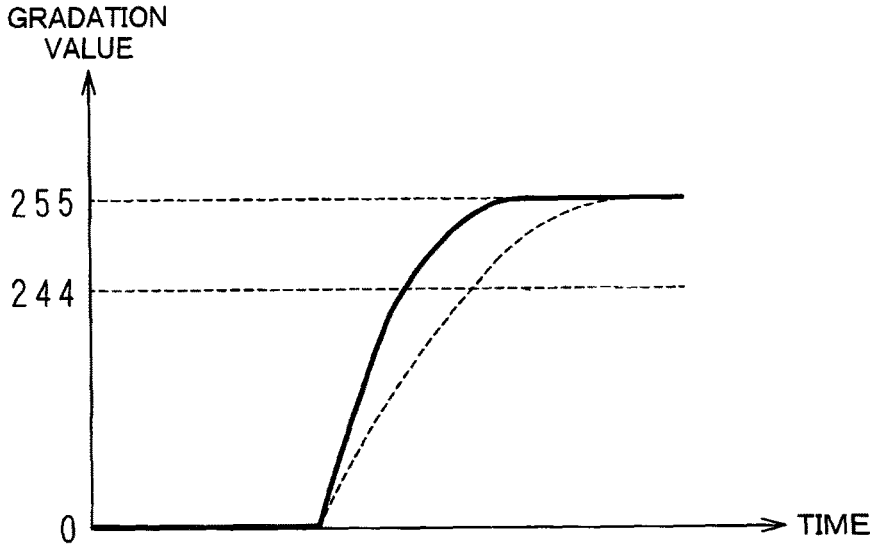
FIG. 4 is a view illustrating characteristics of an example of the overdrive control.

FIG. 4 is a view illustrating characteristics of an example of the overdrive control. FIG. 4 illustrates an example in which the brightness of the pixel is changed from the gradation value 0 to the gradation value 255. A horizontal axis in FIG. 4 illustrates a time, and a vertical axis illustrates the brightness of the pixel by the gradation value. As illustrated in FIG. 3, a gradation value 244 is recorded in the lookup table as the target value for which the brightness of the pixel is to once change by associating with the gradation value 0 in the previous frame and the gradation value 255 in the current frame. Therefore, the overdrive section 1 generates an image signal for once changing the brightness of the pixel from the gradation value 0 to the gradation value 244, and then changing to the gradation value 255, and inputs the generated image signal to the display control section 2. The display control section 2 displays the image on the liquid crystal panel 3 according to the input image signal. In FIG. 4, the response of the brightness of the pixel when performing the overdrive control is illustrated by a solid line. The brightness of the pixel is changed so as to once rise toward the gradation value 244, and then approximate to the gradation value 255. In FIG. 4, the response of the brightness of the pixel in a case of not performing the overdrive control is illustrated by a dashed line. As compared to the case of not performing the overdrive control, when the overdrive control is performed, the brightness of the pixel is changed from the gradation value 0 to the gradation value 255 in a short time.

As the case of changing the brightness of the pixel from the gradation value 0 to the gradation value 255, when the target value is less than the brightness in the current frame, an undershoot is imparted to the brightness of the pixel by the overdrive control. If the target value exceeds the brightness in the current frame, an overshoot is imparted to the brightness of the pixel by the overdrive control. When the target value is equal to the brightness of the current frame, there is no improvement in the change of the brightness of the pixel by the overdrive control. A correspondence relationship between the combination of the brightness of the pixels in two frames and the target value of the brightness of the pixel is appropriately previously determined, and is recorded in the lookup table.

In the present embodiment, when the brightness of the pixel in the current frame is the gradation value 255 which is the maximum value of the displayable brightness, the target value of the brightness for which the brightness of the pixel is to once change from the brightness in the previous frame is the middle value between the value of the brightness of the pixel in the previous frame and the maximum value. As described above, the gradation value 244 is associated with the gradation value 0 in the previous frame and the gradation value 255 in the current frame as the target value (middle value). As illustrated in FIG. 3, in the present embodiment, the gradation value 244 is associated with a gradation value exceeding the gradation value 0 but being the gradation value 128 or less in the previous frame and the gradation value 255 in the current frame as the target value, similar to the case of the gradation value 0 in the previous frame. The gradation value 128 in the previous frame corresponds to a first threshold value in the present invention. The lookup table is determined as described above, if the brightness of the pixel in the previous frame is the gradation value 128 or less, the middle value in the overdrive control is determined to be the gradation value 244 which is a constant. That is, even if the brightness of the pixel in the previous frame exceeds the gradation value 0, in the case of the gradation value 128 or less, when changing the brightness of the pixel to the gradation value 255, the overdrive control the same as the case of changing the brightness of the pixel from the gradation value 0 to the gradation value 255 is performed. The gradation value 244 corresponds to a constant value in the present invention.

In the conventional display apparatus, if the brightness of the pixel in the previous frame exceeds the gradation value 0, the overdrive control the same as the case in which the brightness of the pixel in the previous frame is the gradation value 0 has not been performed. For example, conventionally, in the lookup table, the gradation value 255 is associated with the value exceeding the gradation value 0 in the previous frame and the gradation value 255 in the current frame, and thereby, when changing the brightness of the pixel to the gradation value 255, the overdrive control is not affected. However, as a result of compressing the image data representing one frame by the color conversion section 11 and the quantization section 12, and decompressing the image data by the inverse quantization section 14 and the color inverse conversion section 15, the brightness of the pixel in the previous frame is misidentified as other values, due to an error in the compression and decompression. For example, even if the brightness of the pixel in the previous frame is the gradation value 0, as a result of compressing and decompressing the image data, the brightness of the pixel may be wrongly changed to a gradation value 32, and the brightness of the pixel in the previous frame is misidentified as the gradation value 32. If such a misidentification occurs, conventionally, even when changing the brightness of the pixel from the gradation value 0 to the gradation value 255, a process for changing the brightness of the pixel from the gradation value 32 to the gradation value 255 is performed, and the overdrive control to be originally performed is not performed. Therefore, the response of the change in the brightness of the pixel is delayed, and the image quality of the moving image is deteriorated.

In the present embodiment, unlike the related art, when changing the brightness of the pixel from the brightness exceeding the gradation value 0 to the gradation value 255, the overdrive control the same as the case of changing the brightness of the pixel from the gradation value 0 to the gradation value 255 is performed. Therefore, even if the brightness of the pixel in the previous frame which is the gradation value 0 is misidentified as other values, the overdrive control the same as the case of changing the brightness of the pixel from the gradation value 0 to the gradation value 255 is performed, such that the overdrive control to be originally performed is performed. Therefore, the display apparatus according to the present embodiment may reliably perform the overdrive control even if the brightness of the pixel is misidentified, and the deterioration in the image quality of the moving image may be prevented. For example, in the moving image in which an extreme change in the brightness occurs such as a moving image in which a square graphic of a mixed color moves in a horizontal direction on a white background, the deterioration in the image quality of the moving image is prevented. In particular, it is possible to prevent the deterioration in the image quality of the moving image in the display apparatus using the VA type liquid crystal panel.

In the present embodiment, the value of the brightness of the pixel which exceeds the gradation value 0 but is the first threshold value or less corresponds to a value which may be misidentified for the brightness of the pixel in the previous frame although it should be the gradation value 0 which is the minimum value of brightness. In the present embodiment, the first threshold value is set as the gradation value 128, and the first threshold value is determined based on the condition that an upper limit value of the brightness of the pixel for which the brightness of the pixel in the previous frame, which should be the gradation value 0, may be misidentified is the gradation value 128. By setting the upper limit value of the brightness of the pixel for which the brightness of the pixel in the previous frame, which should be the gradation value 0, may be misidentified due to compression and decompression algorithms to be the first threshold value, the deterioration in the image quality of the moving image caused by the misidentification of the brightness of the pixel may be reliably prevented. The first threshold is appropriately determined according to the compression and decompression algorithms of the image data. The first threshold value may be a value other than the gradation value 128 according to the compression and decompression algorithms.

The misidentification of the brightness of the pixel in the previous frame may occur when an image which is not accounted for in the compression and decompression algorithms is generated. When the display apparatus is the television receiver, the compression and decompression algorithms suitable for an image reflecting nature is often employed, and when an image for a monitor apparatus including a geometric pattern is generated, the misidentification of the brightness of the pixel may be generated due to a compression error. For example, when the image reflecting nature is displayed by a window for a computer as the background, and the window moves according to an operation by the user, the image quality may be deteriorated. In the present embodiment, even when displaying an image incompatible with such the compression and decompression algorithms, the display apparatus may display the moving image without deterioration in the image quality.

Embodiment 2

FIG. 5 is a view conceptually illustrating an example of contents of a lookup table according to Embodiment 2. The other components of the display apparatus except for the lookup table are the same as Embodiment 1. In Embodiment 2, the lookup table is recorded with the gradation value of less than the gradation value 255 as the target value, by associating with a value which exceeds the gradation value 128 but is the gradation value 240 or less in the previous frame and the gradation value 255 in the current frame. These target values are previously determined according to the value of the brightness of the pixel in the previous frame, and correspond to the middle value in the present invention. The lookup table is determined as described above, such that, when the brightness of the pixel in the previous frame exceeds the gradation value 128 but is a gradation value 240 or less, and the brightness of the pixel in the current frame is the gradation value 255, the overdrive section 1 generates an image signal for once changing the brightness of the pixel from the brightness in the previous frame to a prescribed middle value, and then changing to the gradation value 255. When the brightness of the pixel in the previous frame exceeds the gradation value 128 but is the gradation value 240 or less, the middle value is determined to be a large prescribed value as the value of the brightness of the pixel in the previous frame increases, according to the value of the brightness of the pixel in the previous frame. In addition, the gradation value 240 corresponds to a second threshold value in the present invention.

According to Embodiment 1, in the lookup table, the gradation value 255 is associated with a value of the gradation value 144 or more in the previous frame and the gradation value 255 in the current frame as the target value. Thereby, when changing the brightness of the pixel from the value of the gradation value 144 or more to the gradation value 255, the overdrive control is not affected. Meanwhile, in Embodiment 1, when changing the brightness of the pixel from the gradation value 128 to the gradation value 255, the overdrive control is performed so as to once change the brightness of the pixel from the gradation value 128 to the gradation value 244, and then change to the gradation value 255. Therefore, in the pixel having the brightness in the previous frame of the gradation value 128, the response of the change in the brightness is delayed, compared to the case without the overdrive control. Compared to this, the pixel having the brightness in the previous frame of the gradation value 144 is not affected by the overdrive control, when changing the brightness to the gradation value 255, such that the response of the change in the brightness is not delayed. Accordingly, there is a risk to deteriorate the image quality, for example, a difference in the response of the change in the brightness of the pixel within the image occurs, the tailing locally occurs or the like.

In Embodiment 2, even if the brightness of the pixel in the previous frame exceeds the gradation value 128, when changing the brightness of the pixel to the gradation value 255, the overdrive control is performed for once changing the brightness of the pixel from the brightness in the previous frame to the middle value of less than the gradation value 255, and then changing to the gradation value 255. Thereby, also in the pixel having the brightness in the previous frame of exceeding the gradation value 128, similar to the pixel having the brightness of the gradation value 128 or less, the response of the change in the brightness is delayed by the overdrive control. A difference in the response of the change in the brightness of the pixel occurring within the image becomes small, such that the local tailing becomes less obvious, and the deterioration in the image quality is prevented. As described above, in Embodiment 2, even for the brightness of the pixel which may not be a value that the brightness of the pixel of the gradation value 0 is misidentified due to the error of compression and decompression, the overdrive control is performed for once changing the brightness of the pixel to the middle value, and then changing to the gradation value 255, such that an occurrence of a large difference in the response of the change in the brightness between the pixels may be prevented. Thereby, in the display apparatus according to Embodiment 2, it is possible to display the image while more effectively preventing the deterioration in the image quality.

Further, in Embodiment 2, the middle value associated with the brightness of the pixel exceeding the first threshold value in the previous frame is determined to be a large value as the value of the brightness of the pixel in the previous frame increases, such that, even when the brightness of the pixel in the previous frame exceeds the gradation value 128 but is the gradation value 240 or less, the overdrive control may be performed for once changing the brightness of the pixel to the middle value, and then changing to the gradation value 255. In addition, when the brightness of the pixel in the previous frame exceeds the first threshold value, as the value of the brightness of the pixel in the previous frame increases, the middle value is approximated to the gradation value 255, such that the effect on the overdrive control is weakened, and the response of the change in the brightness is improved. Since the response of the change in the brightness of the pixel in the previous frame is gradually improved, the display apparatus may prevent an occurrence of a large difference in the response of the change in the brightness between the pixels, as well as may suppress the deterioration of the response of the change in the brightness. Furthermore, in the present embodiment, the second threshold value is set to be the gradation value 240, but the second threshold value may be set to be other values.

Embodiment 3

FIG. 6 is a view conceptually illustrating an example of contents of a lookup table according to Embodiment 3. The other components of the display apparatus except for the lookup table are the same as Embodiment 1. In Embodiment 3, the first threshold value is set to be a gradation value 80. That is, the gradation value 244 is associated with a value of the gradation value 80 or less in the previous frame and the gradation value 255 in the current frame as the middle value, similar to the case of the gradation value 0 in the previous frame. The lookup table is determined as described above, such that the overdrive section 1 generates an image signal for once changing the brightness of the pixel from the value of the gradation value 80 or less to the gradation value 244, and then changing to the gradation value 255.

On the other hand, in the lookup table, a value exceeding the middle value associated with the gradation value 0 in the previous frame is associated with a value of exceeding the gradation value 80 in the previous frame and the gradation value 255 in the current frame as the middle value. The middle value in the case in which the brightness of the pixel in the previous frame exceeds the gradation value 80 but is the gradation value 240 or less is determined to be a prescribed value which becomes large as the value of brightness of the pixel in the previous frame increases, according to the value of the brightness of the pixel in the previous frame. The lookup table is determined as described above, such that the overdrive section 1 generates an image signal for once changing the brightness of the pixel from the value of exceeding the gradation value 80 but being the gradation value 240 or less to the middle value exceeding the gradation value 244, and then changing to the gradation value 255.

Also in Embodiment 3, similar to Embodiment 1, an upper limit value of the value for which the brightness of the pixel in the previous frame may be misidentified with the gradation value 0 due to an error of the compression and decompression is the gradation value 128. However, in Embodiment 3, the first threshold value is set to be the gradation value 80 which is less than the gradation value 128. When the brightness of the pixel of the gradation value 0 in the previous frame is misidentified, it is highly possible that the brightness is misidentified to the value near the gradation value 0. Accordingly, even when the brightness of the pixel in the previous frame may be misidentified with the gradation value 0, the value near the upper limit value is less likely to be the value that the gradation value 0 is misidentified to be. Further, in Embodiment 1, instead of preventing the deterioration in the image quality of the moving image caused by the error of compression and decompression, the response of the change in the brightness when the brightness of the pixel is changed from the value of the gradation value 128 or less in the previous frame to the gradation value 255 in the current frame is delayed. Therefore, in Embodiment 3, for the value near the upper limit value of the value for which the brightness of the pixel in the previous frame is misidentified with the gradation value 0, the middle value is set to be a value nearer the gradation value 255. Since the response of the change in the brightness is accelerated as the middle value approaches the gradation value 255, the display apparatus may prevent the deterioration in the image quality caused by the error of compression and decompression, as well as may suppress the deterioration of the response of the change in the brightness.

Even when the brightness of the pixel of the gradation value 0 in the previous frame is misidentified as the value near the upper limit value of the value for which the brightness may be misidentified, the brightness of the pixel is affected by the overdrive control, although it is low affected compared to the case of being misidentified as the value near the gradation value 0. Therefore, the display apparatus may prevent the deterioration in the image quality of the moving image. Even if the effect of preventing the deterioration in the image quality of the moving image is weakened, the probability that the brightness of the pixel of the gradation value 0 in the previous frame is misidentified as the value near the upper limit value is low, such that the image quality of the moving image may not be frequently deteriorated.

In addition, in Embodiment 3, similar to Embodiment 2, even if the brightness of the pixel in the previous frame exceeds the gradation value 128, the overdrive section 1 generates an image signal for once changing the brightness of the pixel from the brightness in the previous frame to the middle value, and then changing to the gradation value 255. Therefore, a difference in the response of the change in the brightness of the pixel occurred within the image becomes small, the local tailing becomes less obvious, and the deterioration in the image quality is prevented. Further, also in Embodiment 3, the middle value associated with the brightness of the pixel exceeding the first threshold value in the previous frame is determined to a large value as the value of the brightness of the pixel in the previous frame increases, such that, as the value of the brightness of the pixel in the previous frame increases, the response of the change in the brightness is accelerated. Accordingly, the display apparatus may prevent an occurrence of a large difference in the response of the change in the brightness between the pixels, as well as may suppress the deterioration of the response of the change in the brightness.

Furthermore, the first threshold value is not limited to the gradation value 80, and may be other values, so long as it exceeds the gradation value 0 but is less than the upper limit value of the brightness of the pixel for which the brightness of the pixel in the previous frame, which should be the gradation value 0, may be misidentified. In addition, the second threshold value may be any value other than the gradation value 240.

Further, in the above-described Embodiments 1 to 3, the setting value in the present invention is set to be the gradation value 255 which is the maximum value of the displayable brightness, but the display apparatus of the present invention may have a configuration in which a value of less than the maximum value of the displayable brightness is to be the setting value. In this configuration, when the brightness of the pixel in the previous frame is the first or second threshold value or less, and the brightness of the pixel in the current frame is the setting value or more, the display apparatus performs the overdrive control. In the lookup table, the gradation value corresponding to the middle value between the gradation value in the previous frame and the gradation value in the current frame is associated with the first or second threshold value or less in the previous frame, and with the gradation value of the setting value or more in the current frame. For example, in the configuration in which the setting value is to be a value near the maximum value such as the gradation value 254, when the brightness of the pixel in the previous frame is the first or second threshold value or less, and the brightness of the pixel in the current frame is the maximum value or the value near the maximum value, the display apparatus controls the brightness of the pixel so as to once change it from the brightness of the pixel in the previous frame to the middle value, and then change to the maximum value or the value near the maximum value. Also in the configuration, the display apparatus may reliably perform the overdrive control even if the brightness of the pixel is misidentified, and the deterioration in the image quality of the moving image may be prevented.

In addition, the above-described Embodiments 1 to 3 illustrate the example in which the brightness of the pixel is represented by the 256 gradation values, but the display apparatus may have a configuration representing the brightness of the pixel by another method different from the method representing by the 256 gradation values, such as a method representing the brightness of the pixel as 512 gradation values. Further, the above-described Embodiments 1 to 3 illustrate the example in which the overdrive section 1 is formed by hardware, however, the display apparatus may have a configuration of executing a part of the process in the overdrive section 1 using software.

It is noted that, as used herein and in the appended claims, the singular forms "a", "an", and "the" include plural referents unless the context clearly dictates otherwise.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A display apparatus comprising:

a liquid crystal panel configured to sequentially display a plurality of images respectively including a plurality of pixels;

a storage section configured to sequentially store image data representing each of the images, and read the image data representing one previous image of an image to be displayed; and a control section configured to control a brightness of the pixel included in the image displayed by the liquid crystal panel, so as to, for each of the pixels included in the image, when the brightness of the pixel in the image represented by the image data read by the storage section is a value included in a prescribed range, and the brightness of the pixel in the image to be displayed is a prescribed setting value or more, change the brightness of the pixel from the brightness in the one previous image to a middle value between a value of the brightness in the image represented by the image data and a value of the brightness in the image to be displayed, and then change to a value of the brightness in the image, wherein the control section, when the brightness of the pixel included in the image represented by the image data read by the storage section is equal to or less than a prescribed first threshold value which is less than the setting value but exceeds a minimum value of a displayable brightness, determines the middle value to be a prescribed constant value exceeding the first threshold value, and the control section, when the brightness of the pixel included in the image represented by the image data read by the storage section exceeds the first threshold value and is a prescribed second threshold value or less which is less than the setting value but exceeds the first threshold value, determines the middle value to be a large value as a value of the brightness of the pixel increases exceeding the constant value.

2. The display apparatus according to claim 1, wherein the setting value is a maximum value of the displayable brightness.

3. The display apparatus according to claim 1, wherein the storage section compresses and stores image data, and then reads and decompresses the image data, and the first threshold value is determined according to the compression and decompression algorithms of the image data.

4. The display apparatus according to claim 1, wherein the storage section compresses and stores image data, and then reads and decompresses the image data, and the first threshold value and the second threshold value are determined according to the compression and decompression algorithms of the image data.

5. The display apparatus according to claim 1, wherein the control section stores a corresponding table in which the middle value is associated with the value of the brightness of the pixel, and the control section determines the middle value according to the brightness of the pixel included in the image represented by the image data read by the storage section, based on the corresponding table.

6. A control method of a display apparatus which comprises a liquid crystal panel configured to sequentially display a plurality of images respectively including a plurality of pixels, and a storage section configured to sequentially store image data representing each of the images, and read the image data representing one previous image of an image to be displayed, wherein the display apparatus is configured to control a brightness of the pixel included in the image displayed by the liquid crystal panel, so as to, for each of the pixels included in the image, when the brightness of the pixel in the image represented by the image data read by the storage section is a value included in a prescribed range, and the brightness of the pixel in the image to be displayed is a prescribed setting value or more, change the brightness of the pixel from the brightness in the one previous image to a middle value between a value of the brightness in the image represented by the image data and a value of the brightness in the image to be displayed, and then change to a value of the brightness in the image to be displayed, the control method comprising when the brightness of the pixel included in the image represented by the image data read by the storage section is equal to or less than a prescribed first threshold value which is less than the setting value but exceeds a minimum value of a displayable brightness, determining the middle value to be a prescribed constant value exceeding the first threshold value, and when the brightness of the pixel included in the image represented by the image data read by the storage section exceeds the first threshold value and is a prescribed second threshold value or less which is less than the setting value but exceeds the first threshold value, determining the middle value to be a large value as a value of the brightness of the pixel increases exceeding the constant value.

7. The display apparatus according to claim 3, wherein the first threshold value is an upper limit value of a value for which the brightness of the pixel, included in the image represented by the image data read by the storage section, may be misidentified from the minimum value due to an error of compression and decompression of the image data.

8. The display apparatus according to claim 4, wherein the first threshold value is less than the upper limit value of a value for which the brightness of the pixel, included in the image represented by the image data read by the storage section, may be misidentified from the minimum value due to an error of compression and decompression of the image data, and the second threshold value is the upper limit value or more.

* * * * *